US009890790B2

(12) United States Patent
Miller et al.

(10) Patent No.: US 9,890,790 B2
(45) Date of Patent: Feb. 13, 2018

(54) ADJUSTED ROTATING AIRFOIL

(71) Applicant: ANSALDO ENERGIA SWITZERLAND AG, Baden (CH)

(72) Inventors: Edward Len Miller, Jupiter, FL (US); Stephen Wayne Fiebiger, Jupiter, FL (US); Wes Carl Smith, West Palm Beach, FL (US); Wilm Philipp Hecker, Baden (CH); Andreas Martin Mattheiss, Baden-Wuerttemberg (DE); Reiner Jochen Digele, Biberstein (CH)

(73) Assignee: ANSALDO ENERGIA SWITZERLAND AG (CH)

( * ) Notice: Subject to any disclaimer, the term of this patent is extended or adjusted under 35 U.S.C. 154(b) by 1023 days.

(21) Appl. No.: 14/087,935

(22) Filed: Nov. 22, 2013

(65) Prior Publication Data

US 2015/0147182 A1 May 28, 2015

(51) Int. Cl.
*F01D 5/14* (2006.01)
*F04D 29/32* (2006.01)

(52) U.S. Cl.
CPC ..... *F04D 29/324* (2013.01)

(58) Field of Classification Search
CPC combination set(s) only.
See application file for complete search history.

(56) References Cited

U.S. PATENT DOCUMENTS 7,566,202 B2 * 7/2009 Noshi ..... F01D 5/141 416/223 A

* cited by examiner

*Primary Examiner* — Logan Kraft
*Assistant Examiner* — Jason Fountain
(74) *Attorney, Agent, or Firm* — Hovey Williams LLP

(57) ABSTRACT

A compressor component having an airfoil with a profile in accordance with Table 1 is disclosed. The compressor component, such as a compressor blade, has an increased surface area over a portion of the airfoil chord length. The increased surface area allows for a greater amount of air to be taken in by the airfoil, thus increasing the air flow through the gas turbine engine.

20 Claims, 4 Drawing Sheets

ADJUSTED ROTATING AIRFOIL

CROSS-REFERENCE TO RELATED APPLICATIONS

This application is related by subject matter to the non-provisional patent application Ser. No. 14/087,946 entitled "ADJUSTED STATIONARY AIRFOIL" and assigned to the same assignee.

STATEMENT REGARDING FEDERALLY SPONSORED RESEARCH OR DEVELOPMENT

Not Applicable.

TECHNICAL FIELD

The present invention relates generally to gas turbine engines and more specifically to an airfoil profile having an improved design.

BACKGROUND OF THE INVENTION

A gas turbine engine typically comprises a multi-stage compressor that takes air, which has been drawn into the engine, and compresses it into a higher pressure and temperature. A majority of this air passes to the combustion system, which mixes the compressed and heated air with fuel and contains the resulting reaction that generates the hot combustion gases. These gases then pass through a multi-stage turbine, which, in turn drives the compressor, and possibly a shaft of an electrical generator. Exhaust from the turbine can also be channeled to provide thrust for propulsion of a vehicle.

Typical compressors and turbines comprise a plurality of alternating rows of rotating and stationary airfoils. The stationary airfoils, or vanes, direct the flow of air in a compressor or hot combustion gases in a turbine onto a subsequent row of rotating airfoils, or blades, at the proper orientation in order to maximize the output of the compressor or turbine. The performance of the gas turbine engine is dependent on the mass of air entering the engine. Generally, the greater the amount of air that enters the engine, the more power that is produced.

SUMMARY OF THE INVENTION

The present invention is defined by the claims below. Embodiments of the present invention solve at least the above problems by providing a system and method for, among other things, increasing airflow throughout a plurality of assemblies in a gas turbine engine.

In accordance with the present invention, there is provided a novel and improved airfoil for a compressor component having a redefined airfoil profile. The surface area of the rotor blade is adjusted to allow for increased air flow. The chord length of the rotor blade is increased at the root with the amount of increase tapering towards the tip. By increasing the surface area of the rotor blade, more air may be captured and harnessed by the airfoil, thus increasing the performance of the compressor and the gas turbine engine.

In an embodiment of the present invention, a compressor component having an attachment, a platform, and an airfoil extending radially outward from the platform is disclosed. The airfoil has an uncoated profile substantially in accordance with Cartesian coordinate values of X and Z, for each distance Y in inches as set forth in Table 1, carried to three decimal places.

In another embodiment, an airfoil for a compressor blade is disclosed having an uncoated profile substantially in accordance with Cartesian coordinate values X, Y, and Z as set forth in Table 1, carried to three decimal places, where Y is a distance measured in inches, the X and Z coordinate values being joined in smooth continuing splines to form airfoil sections and the airfoil sections joined smoothly to form the profile.

In another embodiment, a compressor is disclosed in which the compressor comprises a compressor disk having a plurality of compressor blades extending radially outward from the compressor disk. The compressor blades each have an airfoil with an uncoated nominal profile substantially in accordance with Cartesian coordinate values of X, Y and Z, set forth in inches in Table 1, with the Y coordinate values at perpendicular distances from planes normal to a radius from an engine centerline, wherein airfoil sections are defined at each distance Y by connecting the X and Z coordinate values with smooth continuing splines, and the airfoil sections are joined smoothly to form the airfoil profile, where the compressor blades are rotating blades located adjacent to inlet guide vanes of the compressor, the inlet guide vanes being shaped to compliment the profile of the compressor blades.

Although disclosed as an airfoil that is uncoated, it is envisioned that an alternate embodiment of the present invention can include an airfoil that is at least partially coated with an erosion resistant coating, corrosion resistant coating, or a combination thereof. In this case, the coordinates of the airfoil as listed in Table 1 would be prior to a coating being applied to any portion of the airfoil.

Additional advantages and features of the present invention will be set forth in part in a description which follows, and in part will become apparent to those skilled in the art upon examination of the following, or may be learned from practice of the invention. The instant invention will now be described with particular reference to the accompanying drawings.

BRIEF DESCRIPTION OF THE SEVERAL VIEWS OF THE DRAWINGS

The present invention is described in detail below with reference to the attached drawing figures, wherein.

DETAILED DESCRIPTION

The subject matter of the present invention is described with specificity herein to meet statutory requirements. However, the description itself is not intended to limit the scope of this patent. Rather, the inventors have contemplated that the claimed subject matter might also be embodied in other ways, to include different components, combinations of components, steps, or combinations of steps similar to the ones described in this document, in conjunction with other present or future technologies.

Figure 1:
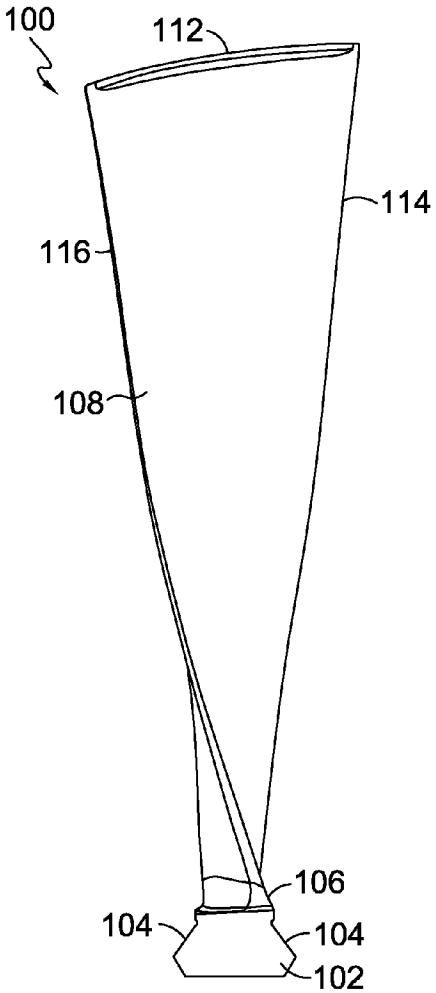
FIG. 1 is a front elevation view of a compressor blade having an airfoil in accordance with an embodiment of the present invention.
Figure 2:
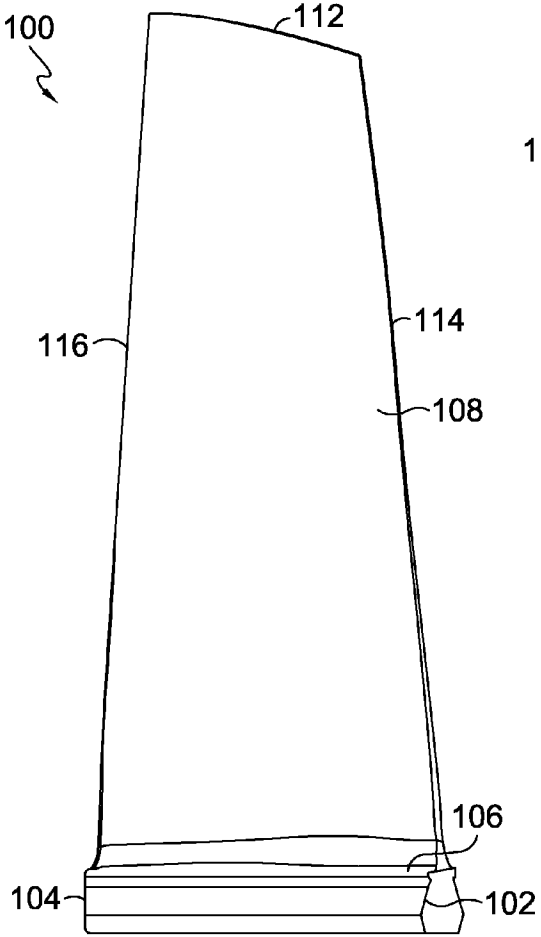
FIG. 2 is a side elevation view of the compressor blade of FIG. 1.
Figure 3:
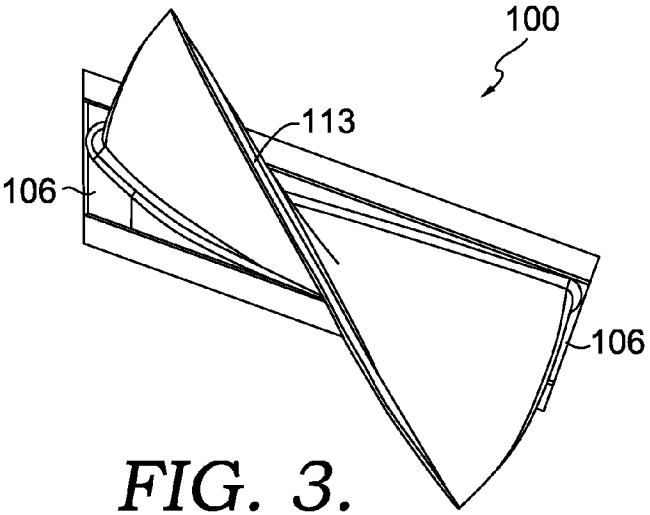
FIG. 3 is a top elevation view of the compressor blade of FIG. 1.

Referring initially to FIGS. 1-3, a compressor blade 100 is shown in accordance with an embodiment of the present invention. The compressor blade 100 comprises an attachment 102, which can also be referred to as a root. The attachment 102 utilizes one or more attachment surfaces 104 that are oriented so as to correspond with a slot in a compressor disk (not depicted) having a matching profile. Such an engagement maintains the blade within the disk, preventing it from moving radially outward due to radial pulling forces associated with the rotation of the compressor disk. For the compressor blade 100, the upper surface of the attachment 102 serves as a platform 106, which aligns with an adjacent surface on an outer diameter of the blade disk to provide a uniform inner wall surface for the incoming air flow to the compressor.

Figure 9:
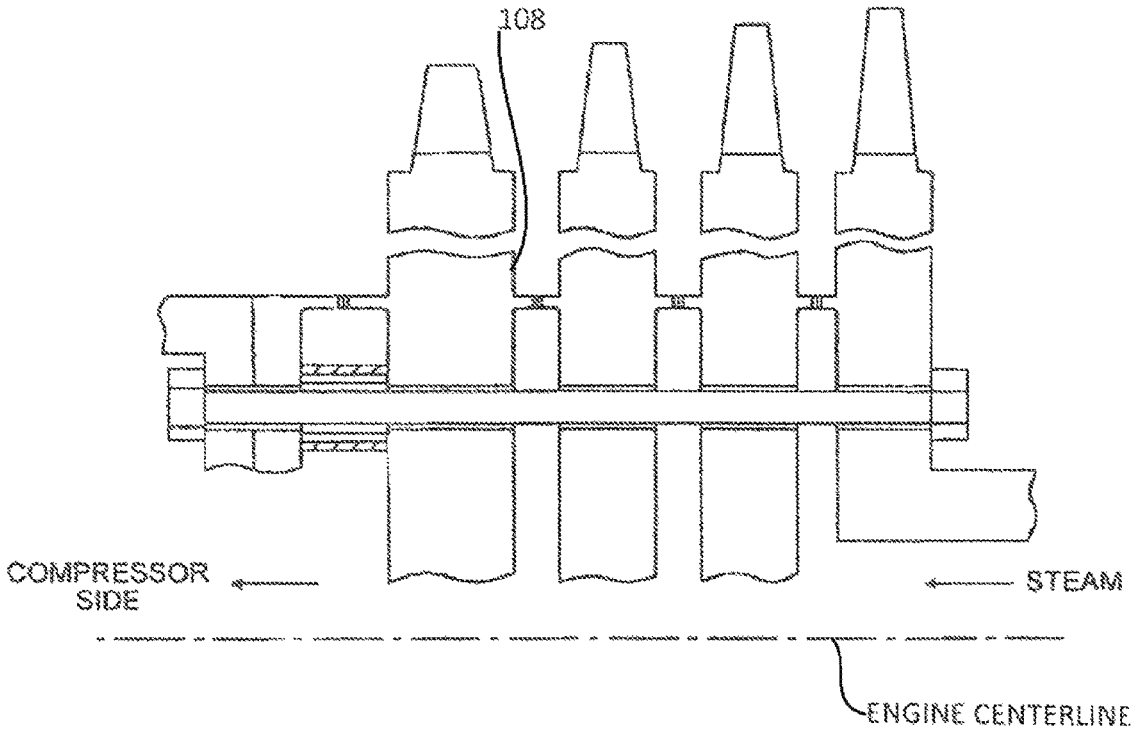
FIG. 9 is a cross-sectional view of a portion of a turbine engine showing the centerline of a turbine engine.

Extending radially outward from the platform 106 is an airfoil 108 having a tip 112, with the tip 112 located at an end of the airfoil 108 opposite of the platform 106. For the compressor blade 100, the airfoil is solid, and fabricated from a material such as a martenestic steel alloy. The airfoil has an uncoated profile substantially in accordance with Cartesian coordinate values of X and Z, for each distance Y, in inches, as set forth in Table 1 below, and carried to three decimal places. The distance Y is measured from the engine centerline, shown in FIG. 9. The X and Z coordinates are distances relative to a coordinate plane origin established at each of the radial Y heights.

A plurality of airfoil sections 110 are established by applying smooth continuing splines between the X, Z coordinate values at each Y height. Smoothly joining each of the airfoil section 110 together form the profile of the airfoil 108. The airfoil 108 can be fabricated by a variety of manufacturing techniques such as forging, casting, milling, and electro-chemical machining (ECM). As such, the airfoil has a series of manufacturing tolerance for the position, profile, twist, and chord that can cause the airfoil 108 to vary by as much as approximately +/−0.012 inches from a nominal state.

The compressor blade 100 is generally fabricated from a steel alloy such as 15-5PH, which is a precipitation-hardened, martensitic stainless steel alloy that is used on parts requiring corrosion resistance and high strength at temperatures up to approximately 600 deg. F. While other alloys could be used, it is preferred that a high-temperature steel alloy be selected because of the operating conditions. Although the compressor blade has been discussed as having an attachment, a platform, and an airfoil, it is to be understood that all of these features of the blade are typically fabricated from the same material and are most likely integral with one another.

In addition to manufacturing tolerances affecting the overall size of the airfoil 108, it is also possible to scale the airfoil 108 to a larger or smaller airfoil size. However, in order to maintain the benefits of this airfoil shape and size, in terms of stiffness and stress, as will be discussed further below, it is necessary to scale the airfoil uniformly in X and Z directions, but Y direction may be scaled separately.

As previously discussed, the profile generated by the X, Y, and Z coordinates of Table 1 is an uncoated profile. While an embodiment of the present invention is an uncoated compressor blade 100, it is possible to add a coating to at least a portion of the airfoil 108 in an alternate embodiment. This coating would have a thickness of up to approximately 0.010 inches. Such coatings can be applied to the airfoil to improve resistance to erosion or to increase temperature capability.

Referring to FIG. 3, positioned at the tip of the blade, opposite of the platform, is a squealer tip 113, which includes a recessed portion so as to minimize the amount of metal located at the blade tip 112. By minimizing the amount of metal, compressor blade 100 can be sized radially to have a tighter fit with the surrounding compressor case such that tolerances can be decreased and efficiency of the compressor increase. Should the squealer tip 113 contact the compressor case and begin to rub the case, the blade will not get as hot due to the smaller amount of material at the blade tip 112.

Depending on the blade configuration, it is possible that a second platform can be positioned proximate the tip 112 of the airfoil 108. A second platform located at the tip 112, is commonly referred to as a shroud and interlocks with a shroud of an adjacent blade. The shrouds provide an outer air path seal that increases efficiency by preventing air from passing over the blade tip 112 and also serves to reduce the vibration of the airfoils 108. The use of a second platform, or a shroud, is common in airfoils having a relatively long radial length.

In an alternate embodiment of the invention, a compressor comprises at least one compressor disk (not depicted) having a plurality of compressor blades 100 that extend radially outward from the compressor disk. As one skilled in the art understands, a compressor typically comprises a plurality of alternating stages of rotating and stationary airfoils that raise the pressure and temperature of a fluid passing through. While the compressor blade 100 having the airfoil 108 can operate in a variety of locations within a compressor, depending on the compressor size, one such location that suits this blade, is adjacent an inlet of the compressor.

For compressor blades in this location, a common durability issue exhibited by prior art blades is erosion of the blade leading edge. The leading edge of the blade (see 114 in FIGS. 1 and 2) is the generally radially extending edge at the forward or upstream end of the blade where the concave and convex surfaces of the airfoil come together. This edge first receives the oncoming air flow, and therefore, is also first impacted by anything entering the compressor. Over time, this leading edge can erode away and weaken the airfoil.

As one skilled in the art understands, as a compressor blade is rotated by a compressor disk, and the weight of the blade pulls radially outward on the disk. However, because of blade design issues such as desired compression of the airflow, blade materials, and compressor size, rarely is the only load a truly radial pulling load. For large unshrouded blades there is usually a substantial amount of blade twist from airfoil root to airfoil tip. Due to the blade's pulling load, the airfoil will tend to untwist or try to straighten itself out. The compression of the airflow also creates load on the airfoil that tries to bend the blade where the airfoil attaches to the platform. Blade pull, untwist, and aero loading result in concentrated steady stress that can occur near the blade's airfoil root leading edge and the blade attachment, as seen with blades of prior art. Airfoil unsteady stress can occur due to the vibratory nature of the blade. Specific vibratory shapes for the blade result in stress concentrations on the airfoil. Blade failure can occur when the blade steady and unsteady stress concentrations occur together. If erosion forms at a location of high steady and unsteady stress then the chance of blade failure is increased.

For a compressor blade, increasing the surface area near the root of the compressor blade may allow for the compressor blade to take in a larger amount of air than the prior art. By taking in a larger amount of air, more air may be compressed and consequently, more power may be produced by the engine. However, due to the fixed geometry of the compressor case, where an airfoil of a compressor blade increases in axial length, there generally must also be a corresponding decrease in the axial length of an adjacent vane, thereby reducing the surface area of the vane. Decreasing the surface area of the stator vane allows for the stator vane to clear the compressor blade.

Figure 4:
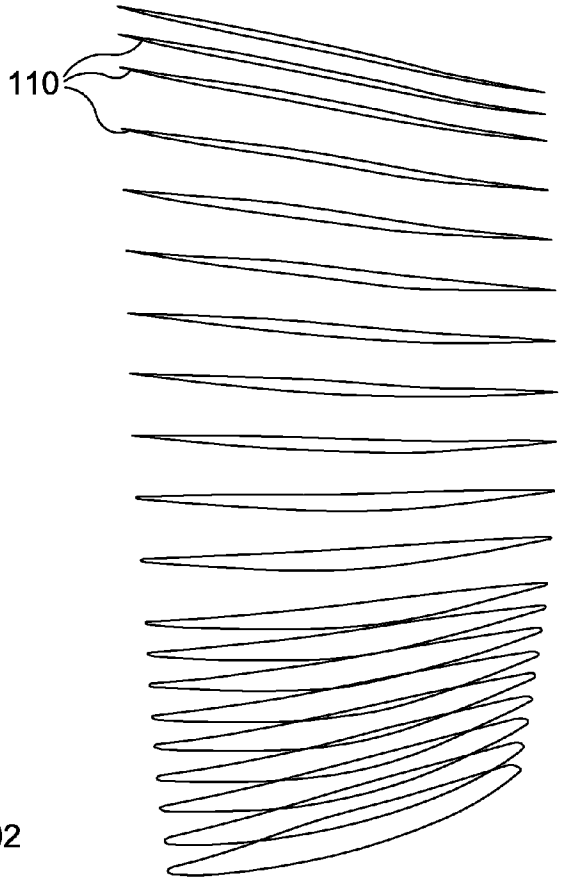
FIG. 4 is a perspective view illustrating a plurality of airfoil sections of a compressor blade generated by the Cartesian coordinates of Table 1.
Figure 5:
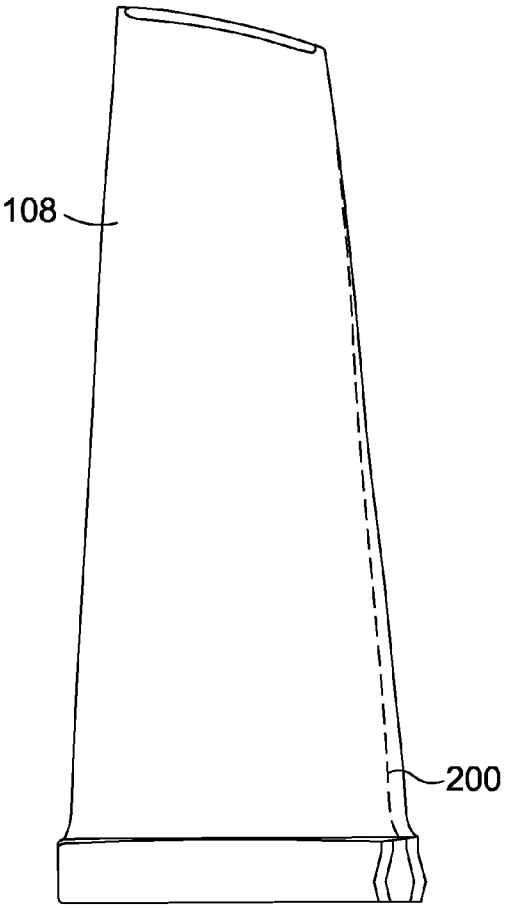
FIG. 5 is a perspective view of a comparison between the airfoil of a compressor blade generated by airfoil sections in accordance with the Cartesian coordinates of Table 1 and a prior art airfoil.
Figure 8:
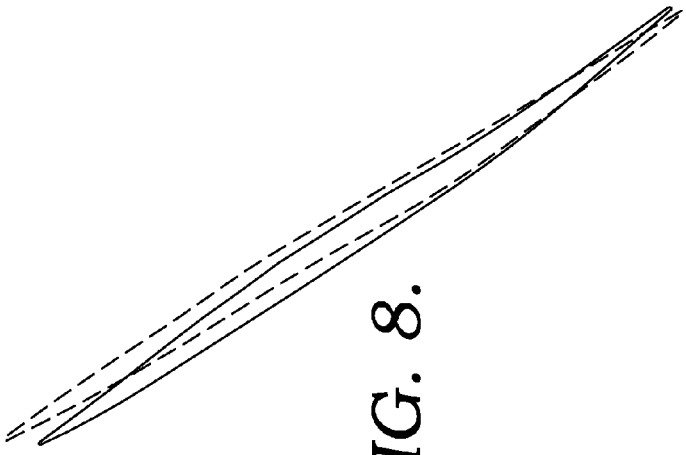
FIGS. 6-8 are enlarged cross sectional views at various radial heights of cross sections overlaying an airfoil of a compressor blade in accordance with an embodiment of the present invention with an airfoil of the prior art.
Figure 7:
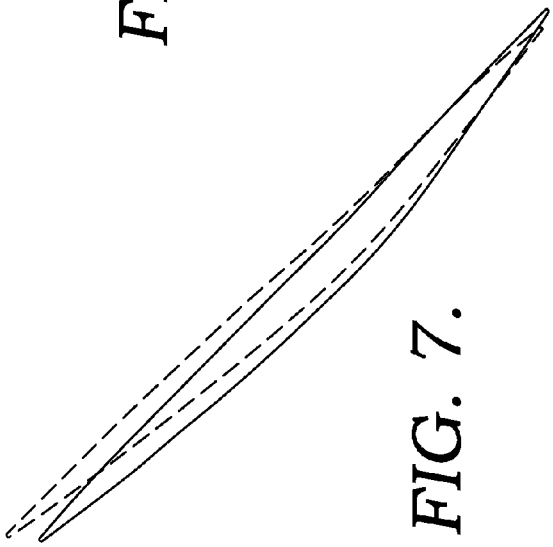
Figure 6:
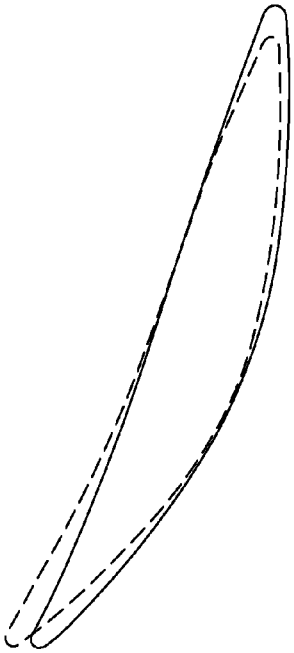

Referring to FIG. 4, a perspective view illustrating a plurality of airfoil sections 110 of a compressor blade generated by the Cartesian coordinates of Table 1 is shown. The modifications to the prior art airfoil, in terms of the increased chord length of the compressor blade, can be seen in more detail in FIGS. 5-8. FIG. 5 is a perspective view depicting the present invention airfoil 108 of a compressor blade with solid lines compared to the prior art airfoil 200, shown in dashed lines. From FIG. 5 it can be determined the areas of the airfoil 108 having an increased chord length. FIGS. 6-8 are enlargements of specific sections of the compressor blade depicted in FIG. 5, with FIG. 6 taken at a radial height of approximately Y=25, FIG. 7 taken at a radial height of approximately Y=32, and FIG. 8 taken at a radial height of approximately Y=38 where Y is measured from the engine centerline.

TABLE 1

| X | Y | Z |
|---|---|---|
| −1.462 | 25.000 | 3.116 |
| −1.351 | 25.000 | 3.016 |
| −1.242 | 25.000 | 2.913 |
| −1.134 | 25.000 | 2.809 |
| −1.028 | 25.000 | 2.703 |
| −0.925 | 25.000 | 2.594 |
| −0.824 | 25.000 | 2.483 |
| −0.726 | 25.000 | 2.370 |
| −0.629 | 25.000 | 2.256 |
| −0.533 | 25.000 | 2.140 |
| −0.440 | 25.000 | 2.023 |
| −0.348 | 25.000 | 1.904 |
| −0.259 | 25.000 | 1.784 |
| −0.172 | 25.000 | 1.662 |
| −0.087 | 25.000 | 1.539 |
| −0.004 | 25.000 | 1.414 |
| 0.077 | 25.000 | 1.287 |
| 0.155 | 25.000 | 1.159 |
| 0.230 | 25.000 | 1.030 |
| 0.302 | 25.000 | 0.898 |
| 0.370 | 25.000 | 0.765 |
| 0.435 | 25.000 | 0.630 |
| 0.496 | 25.000 | 0.493 |
| 0.554 | 25.000 | 0.355 |
| 0.608 | 25.000 | 0.215 |
| 0.658 | 25.000 | 0.073 |
| 0.705 | 25.000 | −0.069 |
| 0.748 | 25.000 | −0.213 |
| 0.787 | 25.000 | −0.357 |
| 0.824 | 25.000 | −0.503 |
| 0.857 | 25.000 | −0.649 |
| 0.887 | 25.000 | −0.796 |

TABLE 1-continued

| X | Y | Z |
|---|---|---|
| 0.914 | 25.000 | −0.943 |
| 0.938 | 25.000 | −1.091 |
| 0.960 | 25.000 | −1.239 |
| 0.979 | 25.000 | −1.388 |
| 0.995 | 25.000 | −1.537 |
| 1.009 | 25.000 | −1.686 |
| 1.021 | 25.000 | −1.836 |
| 1.030 | 25.000 | −1.985 |
| 1.038 | 25.000 | −2.135 |
| 1.043 | 25.000 | −2.285 |
| 1.047 | 25.000 | −2.435 |
| 1.049 | 25.000 | −2.585 |
| 1.049 | 25.000 | −2.734 |
| 1.048 | 25.000 | −2.884 |
| 1.045 | 25.000 | −3.034 |
| 1.041 | 25.000 | −3.184 |
| 1.037 | 25.000 | −3.334 |
| 1.033 | 25.000 | −3.484 |
| −1.486 | 25.000 | 3.135 |
| −1.512 | 25.000 | 3.148 |
| −1.541 | 25.000 | 3.156 |
| −1.570 | 25.000 | 3.156 |
| −1.598 | 25.000 | 3.144 |
| −1.616 | 25.000 | 3.121 |
| −1.623 | 25.000 | 3.092 |
| −1.623 | 25.000 | 3.063 |
| −1.616 | 25.000 | 3.034 |
| −1.603 | 25.000 | 3.007 |
| −1.538 | 25.000 | 2.881 |
| −1.473 | 25.000 | 2.754 |
| −1.410 | 25.000 | 2.627 |
| −1.348 | 25.000 | 2.499 |
| −1.288 | 25.000 | 2.370 |
| −1.230 | 25.000 | 2.240 |
| −1.173 | 25.000 | 2.110 |
| −1.117 | 25.000 | 1.979 |
| −1.063 | 25.000 | 1.848 |
| −1.009 | 25.000 | 1.716 |
| −0.956 | 25.000 | 1.584 |
| −0.903 | 25.000 | 1.452 |
| −0.851 | 25.000 | 1.320 |
| −0.800 | 25.000 | 1.187 |
| −0.749 | 25.000 | 1.054 |
| −0.700 | 25.000 | 0.921 |
| −0.651 | 25.000 | 0.788 |
| −0.604 | 25.000 | 0.654 |
| −0.557 | 25.000 | 0.519 |
| −0.511 | 25.000 | 0.385 |
| −0.467 | 25.000 | 0.250 |
| −0.423 | 25.000 | 0.115 |
| −0.380 | 25.000 | −0.021 |
| −0.337 | 25.000 | −0.157 |
| −0.295 | 25.000 | −0.292 |
| −0.252 | 25.000 | −0.428 |
| −0.210 | 25.000 | −0.563 |
| −0.167 | 25.000 | −0.699 |
| −0.124 | 25.000 | −0.834 |
| −0.080 | 25.000 | −0.970 |
| −0.037 | 25.000 | −1.105 |
| 0.007 | 25.000 | −1.240 |
| 0.051 | 25.000 | −1.376 |
| 0.095 | 25.000 | −1.511 |
| 0.140 | 25.000 | −1.646 |
| 0.185 | 25.000 | −1.780 |
| 0.231 | 25.000 | −1.915 |
| 0.276 | 25.000 | −2.050 |
| 0.323 | 25.000 | −2.184 |
| 0.369 | 25.000 | −2.318 |
| 0.416 | 25.000 | −2.453 |
| 0.463 | 25.000 | −2.587 |
| 0.510 | 25.000 | −2.721 |
| 0.558 | 25.000 | −2.855 |
| 0.605 | 25.000 | −2.989 |
| 0.653 | 25.000 | −3.123 |
| 0.701 | 25.000 | −3.256 |
| 0.750 | 25.000 | −3.390 |
| 0.800 | 25.000 | −3.523 |
| 0.815 | 25.000 | −3.555 |

TABLE 1-continued

| X | Y | Z |
|---|---|---|
| 0.837 | 25.000 | −3.582 |
| 0.866 | 25.000 | −3.602 |
| 0.900 | 25.000 | −3.613 |
| 0.935 | 25.000 | −3.614 |
| 0.968 | 25.000 | −3.602 |
| 0.995 | 25.000 | −3.580 |
| 1.016 | 25.000 | −3.552 |
| 1.029 | 25.000 | −3.519 |
| −1.807 | 26.650 | 2.976 |
| −1.731 | 26.650 | 2.852 |
| −1.655 | 26.650 | 2.728 |
| −1.580 | 26.650 | 2.604 |
| −1.505 | 26.650 | 2.479 |
| −1.430 | 26.650 | 2.354 |
| −1.357 | 26.650 | 2.228 |
| −1.284 | 26.650 | 2.102 |
| −1.212 | 26.650 | 1.976 |
| −1.141 | 26.650 | 1.849 |
| −1.070 | 26.650 | 1.722 |
| −1.000 | 26.650 | 1.594 |
| −0.931 | 26.650 | 1.466 |
| −0.861 | 26.650 | 1.338 |
| −0.793 | 26.650 | 1.210 |
| −0.725 | 26.650 | 1.081 |
| −0.658 | 26.650 | 0.952 |
| −0.592 | 26.650 | 0.823 |
| −0.527 | 26.650 | 0.692 |
| −0.463 | 26.650 | 0.561 |
| −0.401 | 26.650 | 0.430 |
| −0.340 | 26.650 | 0.298 |
| −0.280 | 26.650 | 0.165 |
| −0.221 | 26.650 | 0.032 |
| −0.163 | 26.650 | −0.101 |
| −0.105 | 26.650 | −0.235 |
| −0.048 | 26.650 | −0.369 |
| 0.009 | 26.650 | −0.503 |
| 0.066 | 26.650 | −0.636 |
| 0.123 | 26.650 | −0.770 |
| 0.181 | 26.650 | −0.904 |
| 0.238 | 26.650 | −1.038 |
| 0.296 | 26.650 | −1.171 |
| 0.353 | 26.650 | −1.305 |
| 0.412 | 26.650 | −1.438 |
| 0.470 | 26.650 | −1.571 |
| 0.529 | 26.650 | −1.705 |
| 0.588 | 26.650 | −1.837 |
| 0.648 | 26.650 | −1.970 |
| 0.709 | 26.650 | −2.102 |
| 0.770 | 26.650 | −2.235 |
| 0.831 | 26.650 | −2.367 |
| 0.893 | 26.650 | −2.498 |
| 0.955 | 26.650 | −2.630 |
| 1.018 | 26.650 | −2.761 |
| 1.081 | 26.650 | −2.892 |
| 1.145 | 26.650 | −3.023 |
| 1.210 | 26.650 | −3.153 |
| 1.276 | 26.650 | −3.283 |
| 1.343 | 26.650 | −3.412 |
| −1.818 | 26.650 | 2.995 |
| −1.824 | 26.650 | 3.016 |
| −1.825 | 26.650 | 3.038 |
| −1.820 | 26.650 | 3.059 |
| −1.808 | 26.650 | 3.077 |
| −1.788 | 26.650 | 3.085 |
| −1.766 | 26.650 | 3.086 |
| −1.745 | 26.650 | 3.081 |
| −1.725 | 26.650 | 3.072 |
| −1.708 | 26.650 | 3.058 |
| −1.596 | 26.650 | 2.957 |
| −1.483 | 26.650 | 2.856 |
| −1.372 | 26.650 | 2.754 |
| −1.261 | 26.650 | 2.651 |
| −1.151 | 26.650 | 2.547 |
| −1.043 | 26.650 | 2.442 |
| −0.935 | 26.650 | 2.335 |
| −0.829 | 26.650 | 2.228 |
| −0.724 | 26.650 | 2.119 |
| −0.620 | 26.650 | 2.009 |

TABLE 1-continued

| X | Y | Z |
|---|---|---|
| −0.518 | 26.650 | 1.898 |
| −0.416 | 26.650 | 1.786 |
| −0.317 | 26.650 | 1.672 |
| −0.219 | 26.650 | 1.556 |
| −0.123 | 26.650 | 1.439 |
| −0.029 | 26.650 | 1.321 |
| 0.062 | 26.650 | 1.201 |
| 0.151 | 26.650 | 1.078 |
| 0.237 | 26.650 | 0.954 |
| 0.320 | 26.650 | 0.827 |
| 0.399 | 26.650 | 0.699 |
| 0.475 | 26.650 | 0.568 |
| 0.547 | 26.650 | 0.435 |
| 0.615 | 26.650 | 0.300 |
| 0.680 | 26.650 | 0.163 |
| 0.741 | 26.650 | 0.025 |
| 0.798 | 26.650 | −0.116 |
| 0.851 | 26.650 | −0.257 |
| 0.902 | 26.650 | −0.399 |
| 0.949 | 26.650 | −0.543 |
| 0.994 | 26.650 | −0.688 |
| 1.036 | 26.650 | −0.833 |
| 1.075 | 26.650 | −0.979 |
| 1.113 | 26.650 | −1.125 |
| 1.148 | 26.650 | −1.272 |
| 1.181 | 26.650 | −1.420 |
| 1.213 | 26.650 | −1.568 |
| 1.243 | 26.650 | −1.716 |
| 1.272 | 26.650 | −1.864 |
| 1.299 | 26.650 | −2.013 |
| 1.325 | 26.650 | −2.162 |
| 1.350 | 26.650 | −2.311 |
| 1.374 | 26.650 | −2.461 |
| 1.396 | 26.650 | −2.610 |
| 1.418 | 26.650 | −2.760 |
| 1.439 | 26.650 | −2.910 |
| 1.460 | 26.650 | −3.059 |
| 1.481 | 26.650 | −3.209 |
| 1.504 | 26.650 | −3.359 |
| 1.357 | 26.650 | −3.433 |
| 1.376 | 26.650 | −3.449 |
| 1.399 | 26.650 | −3.459 |
| 1.423 | 26.650 | −3.464 |
| 1.448 | 26.650 | −3.460 |
| 1.470 | 26.650 | −3.448 |
| 1.487 | 26.650 | −3.430 |
| 1.499 | 26.650 | −3.408 |
| 1.505 | 26.650 | −3.384 |
| −2.014 | 28.300 | 2.915 |
| −1.930 | 28.300 | 2.792 |
| −1.846 | 28.300 | 2.669 |
| −1.763 | 28.300 | 2.546 |
| −1.679 | 28.300 | 2.423 |
| −1.596 | 28.300 | 2.300 |
| −1.513 | 28.300 | 2.177 |
| −1.429 | 28.300 | 2.054 |
| −1.346 | 28.300 | 1.931 |
| −1.263 | 28.300 | 1.808 |
| −1.179 | 28.300 | 1.685 |
| −1.096 | 28.300 | 1.561 |
| −1.014 | 28.300 | 1.438 |
| −0.931 | 28.300 | 1.314 |
| −0.848 | 28.300 | 1.191 |
| −0.766 | 28.300 | 1.067 |
| −0.685 | 28.300 | 0.943 |
| −0.604 | 28.300 | 0.818 |
| −0.523 | 28.300 | 0.693 |
| −0.443 | 28.300 | 0.568 |
| −0.364 | 28.300 | 0.442 |
| −0.286 | 28.300 | 0.315 |
| −0.208 | 28.300 | 0.189 |
| −0.132 | 28.300 | 0.061 |
| −0.055 | 28.300 | −0.066 |
| 0.020 | 28.300 | −0.194 |
| 0.095 | 28.300 | −0.323 |
| 0.169 | 28.300 | −0.452 |
| 0.243 | 28.300 | −0.580 |
| 0.317 | 28.300 | −0.709 |

TABLE 1-continued

| X | Y | Z |
|---|---|---|
| 0.391 | 28.300 | −0.839 |
| 0.465 | 28.300 | −0.968 |
| 0.539 | 28.300 | −1.097 |
| 0.613 | 28.300 | −1.225 |
| 0.687 | 28.300 | −1.354 |
| 0.762 | 28.300 | −1.483 |
| 0.837 | 28.300 | −1.611 |
| 0.913 | 28.300 | −1.739 |
| 0.989 | 28.300 | −1.867 |
| 1.065 | 28.300 | −1.994 |
| 1.142 | 28.300 | −2.121 |
| 1.220 | 28.300 | −2.248 |
| 1.298 | 28.300 | −2.375 |
| 1.376 | 28.300 | −2.501 |
| 1.454 | 28.300 | −2.627 |
| 1.533 | 28.300 | −2.753 |
| 1.613 | 28.300 | −2.879 |
| 1.693 | 28.300 | −3.004 |
| 1.773 | 28.300 | −3.129 |
| 1.854 | 28.300 | −3.254 |
| 1.865 | 28.300 | −3.269 |
| 1.880 | 28.300 | −3.281 |
| 1.898 | 28.300 | −3.289 |
| 1.916 | 28.300 | −3.292 |
| 1.935 | 28.300 | −3.289 |
| 1.950 | 28.300 | −3.277 |
| 1.959 | 28.300 | −3.260 |
| 1.964 | 28.300 | −3.242 |
| 1.965 | 28.300 | −3.223 |
| 1.960 | 28.300 | −3.204 |
| 1.916 | 28.300 | −3.058 |
| 1.872 | 28.300 | −2.912 |
| 1.827 | 28.300 | −2.766 |
| 1.783 | 28.300 | −2.621 |
| 1.738 | 28.300 | −2.475 |
| 1.693 | 28.300 | −2.329 |
| 1.646 | 28.300 | −2.184 |
| 1.599 | 28.300 | −2.039 |
| 1.551 | 28.300 | −1.894 |
| 1.502 | 28.300 | −1.750 |
| 1.452 | 28.300 | −1.606 |
| 1.401 | 28.300 | −1.462 |
| 1.349 | 28.300 | −1.319 |
| 1.295 | 28.300 | −1.176 |
| 1.240 | 28.300 | −1.034 |
| 1.183 | 28.300 | −0.892 |
| 1.124 | 28.300 | −0.751 |
| 1.064 | 28.300 | −0.611 |
| 1.001 | 28.300 | −0.472 |
| 0.936 | 28.300 | −0.335 |
| 0.868 | 28.300 | −0.198 |
| 0.797 | 28.300 | −0.063 |
| 0.723 | 28.300 | 0.071 |
| 0.646 | 28.300 | 0.202 |
| 0.566 | 28.300 | 0.332 |
| 0.482 | 28.300 | 0.459 |
| 0.396 | 28.300 | 0.585 |
| 0.306 | 28.300 | 0.709 |
| 0.214 | 28.300 | 0.830 |
| 0.119 | 28.300 | 0.950 |
| 0.022 | 28.300 | 1.068 |
| −0.077 | 28.300 | 1.184 |
| −0.177 | 28.300 | 1.298 |
| −0.280 | 28.300 | 1.411 |
| −0.384 | 28.300 | 1.522 |
| −0.490 | 28.300 | 1.632 |
| −0.596 | 28.300 | 1.741 |
| −0.704 | 28.300 | 1.849 |
| −0.813 | 28.300 | 1.956 |
| −0.923 | 28.300 | 2.061 |
| −1.034 | 28.300 | 2.166 |
| −1.146 | 28.300 | 2.270 |
| −1.258 | 28.300 | 2.373 |
| −1.371 | 28.300 | 2.476 |
| −1.485 | 28.300 | 2.577 |
| −1.599 | 28.300 | 2.678 |
| −1.714 | 28.300 | 2.778 |
| −1.830 | 28.300 | 2.878 |

TABLE 1-continued

| X | Y | Z |
|---|---|---|
| −1.947 | 28.300 | 2.976 |
| −1.960 | 28.300 | 2.986 |
| −1.974 | 28.300 | 2.992 |
| −1.990 | 28.300 | 2.996 |
| −2.006 | 28.300 | 2.996 |
| −2.020 | 28.300 | 2.989 |
| −2.029 | 28.300 | 2.975 |
| −2.031 | 28.300 | 2.959 |
| −2.028 | 28.300 | 2.944 |
| −2.023 | 28.300 | 2.929 |
| −2.256 | 29.950 | 2.837 |
| −2.162 | 29.950 | 2.716 |
| −2.069 | 29.950 | 2.595 |
| −1.977 | 29.950 | 2.474 |
| −1.884 | 29.950 | 2.353 |
| −1.791 | 29.950 | 2.232 |
| −1.698 | 29.950 | 2.112 |
| −1.605 | 29.950 | 1.991 |
| −1.511 | 29.950 | 1.871 |
| −1.417 | 29.950 | 1.751 |
| −1.323 | 29.950 | 1.631 |
| −1.229 | 29.950 | 1.511 |
| −1.134 | 29.950 | 1.392 |
| −1.040 | 29.950 | 1.272 |
| −0.945 | 29.950 | 1.153 |
| −0.850 | 29.950 | 1.033 |
| −0.755 | 29.950 | 0.914 |
| −0.661 | 29.950 | 0.794 |
| −0.566 | 29.950 | 0.675 |
| −0.471 | 29.950 | 0.556 |
| −0.376 | 29.950 | 0.437 |
| −0.281 | 29.950 | 0.317 |
| −0.186 | 29.950 | 0.198 |
| −0.092 | 29.950 | 0.078 |
| 0.002 | 29.950 | −0.042 |
| 0.096 | 29.950 | −0.162 |
| 0.189 | 29.950 | −0.283 |
| 0.281 | 29.950 | −0.404 |
| 0.373 | 29.950 | −0.526 |
| 0.464 | 29.950 | −0.648 |
| 0.555 | 29.950 | −0.770 |
| 0.645 | 29.950 | −0.893 |
| 0.735 | 29.950 | −1.016 |
| 0.825 | 29.950 | −1.139 |
| 0.914 | 29.950 | −1.263 |
| 1.004 | 29.950 | −1.386 |
| 1.093 | 29.950 | −1.510 |
| 1.183 | 29.950 | −1.633 |
| 1.273 | 29.950 | −1.756 |
| 1.364 | 29.950 | −1.878 |
| 1.455 | 29.950 | −2.000 |
| 1.546 | 29.950 | −2.123 |
| 1.638 | 29.950 | −2.244 |
| 1.730 | 29.950 | −2.366 |
| 1.823 | 29.950 | −2.487 |
| 1.916 | 29.950 | −2.608 |
| 2.009 | 29.950 | −2.728 |
| 2.103 | 29.950 | −2.848 |
| 2.197 | 29.950 | −2.968 |
| 2.291 | 29.950 | −3.088 |
| 2.300 | 29.950 | −3.098 |
| 2.310 | 29.950 | −3.105 |
| 2.323 | 29.950 | −3.109 |
| 2.336 | 29.950 | −3.111 |
| 2.348 | 29.950 | −3.107 |
| 2.357 | 29.950 | −3.097 |
| 2.362 | 29.950 | −3.085 |
| 2.363 | 29.950 | −3.072 |
| 2.362 | 29.950 | −3.060 |
| 2.357 | 29.950 | −3.047 |
| 2.291 | 29.950 | −2.907 |
| 2.225 | 29.950 | −2.767 |
| 2.159 | 29.950 | −2.627 |
| 2.093 | 29.950 | −2.487 |
| 2.027 | 29.950 | −2.347 |
| 1.960 | 29.950 | −2.207 |
| 1.893 | 29.950 | −2.068 |
| 1.826 | 29.950 | −1.928 |

TABLE 1-continued

| X | Y | Z |
|---|---|---|
| 1.758 | 29.950 | −1.789 |
| 1.689 | 29.950 | −1.651 |
| 1.620 | 29.950 | −1.512 |
| 1.550 | 29.950 | −1.374 |
| 1.478 | 29.950 | −1.237 |
| 1.406 | 29.950 | −1.100 |
| 1.332 | 29.950 | −0.964 |
| 1.256 | 29.950 | −0.829 |
| 1.179 | 29.950 | −0.695 |
| 1.100 | 29.950 | −0.562 |
| 1.018 | 29.950 | −0.430 |
| 0.934 | 29.950 | −0.300 |
| 0.848 | 29.950 | −0.171 |
| 0.759 | 29.950 | −0.045 |
| 0.668 | 29.950 | 0.080 |
| 0.574 | 29.950 | 0.203 |
| 0.477 | 29.950 | 0.325 |
| 0.379 | 29.950 | 0.444 |
| 0.278 | 29.950 | 0.561 |
| 0.175 | 29.950 | 0.677 |
| 0.071 | 29.950 | 0.792 |
| −0.035 | 29.950 | 0.905 |
| −0.142 | 29.950 | 1.016 |
| −0.250 | 29.950 | 1.127 |
| −0.359 | 29.950 | 1.237 |
| −0.470 | 29.950 | 1.346 |
| −0.581 | 29.950 | 1.453 |
| −0.693 | 29.950 | 1.560 |
| −0.805 | 29.950 | 1.666 |
| −0.919 | 29.950 | 1.772 |
| −1.033 | 29.950 | 1.876 |
| −1.148 | 29.950 | 1.980 |
| −1.264 | 29.950 | 2.083 |
| −1.380 | 29.950 | 2.185 |
| −1.497 | 29.950 | 2.287 |
| −1.614 | 29.950 | 2.388 |
| −1.732 | 29.950 | 2.488 |
| −1.850 | 29.950 | 2.588 |
| −1.969 | 29.950 | 2.687 |
| −2.090 | 29.950 | 2.785 |
| −2.211 | 29.950 | 2.881 |
| −2.221 | 29.950 | 2.887 |
| −2.231 | 29.950 | 2.891 |
| −2.242 | 29.950 | 2.893 |
| −2.253 | 29.950 | 2.893 |
| −2.263 | 29.950 | 2.887 |
| −2.268 | 29.950 | 2.878 |
| −2.269 | 29.950 | 2.867 |
| −2.267 | 29.950 | 2.856 |
| −2.262 | 29.950 | 2.846 |
| −2.487 | 31.600 | 2.745 |
| −2.383 | 31.600 | 2.628 |
| −2.279 | 31.600 | 2.512 |
| −2.176 | 31.600 | 2.395 |
| −2.073 | 31.600 | 2.278 |
| −1.969 | 31.600 | 2.161 |
| −1.866 | 31.600 | 2.044 |
| −1.763 | 31.600 | 1.927 |
| −1.659 | 31.600 | 1.810 |
| −1.555 | 31.600 | 1.693 |
| −1.451 | 31.600 | 1.577 |
| −1.347 | 31.600 | 1.461 |
| −1.242 | 31.600 | 1.345 |
| −1.137 | 31.600 | 1.229 |
| −1.032 | 31.600 | 1.114 |
| −0.926 | 31.600 | 0.999 |
| −0.820 | 31.600 | 0.884 |
| −0.714 | 31.600 | 0.770 |
| −0.607 | 31.600 | 0.656 |
| −0.500 | 31.600 | 0.543 |
| −0.392 | 31.600 | 0.430 |
| −0.284 | 31.600 | 0.317 |
| −0.176 | 31.600 | 0.204 |
| −0.068 | 31.600 | 0.092 |
| 0.041 | 31.600 | −0.020 |
| 0.149 | 31.600 | −0.132 |
| 0.258 | 31.600 | −0.245 |
| 0.366 | 31.600 | −0.357 |

TABLE 1-continued

| X | Y | Z |
|---|---|---|
| 0.473 | 31.600 | −0.471 |
| 0.580 | 31.600 | −0.585 |
| 0.685 | 31.600 | −0.700 |
| 0.790 | 31.600 | −0.815 |
| 0.894 | 31.600 | −0.932 |
| 0.997 | 31.600 | −1.049 |
| 1.099 | 31.600 | −1.167 |
| 1.201 | 31.600 | −1.285 |
| 1.303 | 31.600 | −1.404 |
| 1.405 | 31.600 | −1.522 |
| 1.507 | 31.600 | −1.640 |
| 1.609 | 31.600 | −1.758 |
| 1.712 | 31.600 | −1.876 |
| 1.815 | 31.600 | −1.993 |
| 1.919 | 31.600 | −2.109 |
| 2.024 | 31.600 | −2.225 |
| 2.129 | 31.600 | −2.341 |
| 2.234 | 31.600 | −2.456 |
| 2.340 | 31.600 | −2.570 |
| 2.447 | 31.600 | −2.684 |
| 2.554 | 31.600 | −2.798 |
| 2.662 | 31.600 | −2.911 |
| 2.668 | 31.600 | −2.917 |
| 2.676 | 31.600 | −2.921 |
| 2.685 | 31.600 | −2.923 |
| 2.694 | 31.600 | −2.922 |
| 2.702 | 31.600 | −2.919 |
| 2.708 | 31.600 | −2.912 |
| 2.710 | 31.600 | −2.903 |
| 2.710 | 31.600 | −2.894 |
| 2.708 | 31.600 | −2.885 |
| 2.704 | 31.600 | −2.878 |
| 2.618 | 31.600 | −2.746 |
| 2.532 | 31.600 | −2.614 |
| 2.447 | 31.600 | −2.481 |
| 2.361 | 31.600 | −2.349 |
| 2.276 | 31.600 | −2.216 |
| 2.191 | 31.600 | −2.083 |
| 2.106 | 31.600 | −1.951 |
| 2.021 | 31.600 | −1.819 |
| 1.935 | 31.600 | −1.686 |
| 1.849 | 31.600 | −1.554 |
| 1.763 | 31.600 | −1.423 |
| 1.676 | 31.600 | −1.292 |
| 1.588 | 31.600 | −1.161 |
| 1.499 | 31.600 | −1.031 |
| 1.409 | 31.600 | −0.901 |
| 1.317 | 31.600 | −0.773 |
| 1.224 | 31.600 | −0.646 |
| 1.128 | 31.600 | −0.521 |
| 1.031 | 31.600 | −0.398 |
| 0.930 | 31.600 | −0.276 |
| 0.828 | 31.600 | −0.157 |
| 0.723 | 31.600 | −0.039 |
| 0.616 | 31.600 | 0.077 |
| 0.508 | 31.600 | 0.191 |
| 0.398 | 31.600 | 0.304 |
| 0.286 | 31.600 | 0.415 |
| 0.173 | 31.600 | 0.525 |
| 0.060 | 31.600 | 0.634 |
| −0.055 | 31.600 | 0.742 |
| −0.171 | 31.600 | 0.849 |
| −0.287 | 31.600 | 0.955 |
| −0.403 | 31.600 | 1.061 |
| −0.520 | 31.600 | 1.167 |
| −0.638 | 31.600 | 1.272 |
| −0.755 | 31.600 | 1.376 |
| −0.874 | 31.600 | 1.480 |
| −0.993 | 31.600 | 1.584 |
| −1.112 | 31.600 | 1.686 |
| −1.232 | 31.600 | 1.789 |
| −1.352 | 31.600 | 1.891 |
| −1.472 | 31.600 | 1.992 |
| −1.593 | 31.600 | 2.093 |
| −1.714 | 31.600 | 2.194 |
| −1.836 | 31.600 | 2.294 |
| −1.959 | 31.600 | 2.393 |
| −2.082 | 31.600 | 2.491 |

TABLE 1-continued

| X | Y | Z |
|---|---|---|
| −2.206 | 31.600 | 2.588 |
| −2.330 | 31.600 | 2.684 |
| −2.456 | 31.600 | 2.779 |
| −2.464 | 31.600 | 2.784 |
| −2.472 | 31.600 | 2.787 |
| −2.480 | 31.600 | 2.789 |
| −2.489 | 31.600 | 2.788 |
| −2.497 | 31.600 | 2.784 |
| −2.500 | 31.600 | 2.776 |
| −2.500 | 31.600 | 2.767 |
| −2.497 | 31.600 | 2.759 |
| −2.493 | 31.600 | 2.751 |
| −2.687 | 33.250 | 2.651 |
| −2.573 | 33.250 | 2.539 |
| −2.461 | 33.250 | 2.426 |
| −2.348 | 33.250 | 2.314 |
| −2.236 | 33.250 | 2.201 |
| −2.125 | 33.250 | 2.087 |
| −2.013 | 33.250 | 1.974 |
| −1.901 | 33.250 | 1.861 |
| −1.789 | 33.250 | 1.747 |
| −1.677 | 33.250 | 1.634 |
| −1.565 | 33.250 | 1.521 |
| −1.453 | 33.250 | 1.408 |
| −1.341 | 33.250 | 1.296 |
| −1.228 | 33.250 | 1.183 |
| −1.115 | 33.250 | 1.071 |
| −1.001 | 33.250 | 0.960 |
| −0.887 | 33.250 | 0.849 |
| −0.772 | 33.250 | 0.739 |
| −0.657 | 33.250 | 0.629 |
| −0.541 | 33.250 | 0.520 |
| −0.424 | 33.250 | 0.411 |
| −0.307 | 33.250 | 0.303 |
| −0.190 | 33.250 | 0.196 |
| −0.071 | 33.250 | 0.090 |
| 0.047 | 33.250 | −0.016 |
| 0.166 | 33.250 | −0.122 |
| 0.286 | 33.250 | −0.227 |
| 0.405 | 33.250 | −0.332 |
| 0.524 | 33.250 | −0.438 |
| 0.643 | 33.250 | −0.544 |
| 0.761 | 33.250 | −0.651 |
| 0.878 | 33.250 | −0.759 |
| 0.994 | 33.250 | −0.868 |
| 1.109 | 33.250 | −0.978 |
| 1.222 | 33.250 | −1.090 |
| 1.335 | 33.250 | −1.202 |
| 1.448 | 33.250 | −1.314 |
| 1.560 | 33.250 | −1.427 |
| 1.673 | 33.250 | −1.540 |
| 1.785 | 33.250 | −1.653 |
| 1.898 | 33.250 | −1.765 |
| 2.011 | 33.250 | −1.877 |
| 2.124 | 33.250 | −1.989 |
| 2.238 | 33.250 | −2.101 |
| 2.352 | 33.250 | −2.211 |
| 2.466 | 33.250 | −2.322 |
| 2.582 | 33.250 | −2.431 |
| 2.698 | 33.250 | −2.540 |
| 2.815 | 33.250 | −2.648 |
| 2.933 | 33.250 | −2.755 |
| 2.938 | 33.250 | −2.760 |
| 2.944 | 33.250 | −2.762 |
| 2.951 | 33.250 | −2.763 |
| 2.958 | 33.250 | −2.762 |
| 2.964 | 33.250 | −2.758 |
| 2.967 | 33.250 | −2.752 |
| 2.969 | 33.250 | −2.746 |
| 2.969 | 33.250 | −2.739 |
| 2.967 | 33.250 | −2.733 |
| 2.963 | 33.250 | −2.727 |
| 2.863 | 33.250 | −2.602 |
| 2.764 | 33.250 | −2.476 |
| 2.666 | 33.250 | −2.349 |
| 2.568 | 33.250 | −2.223 |
| 2.470 | 33.250 | −2.096 |
| 2.372 | 33.250 | −1.969 |

TABLE 1-continued

| X | Y | Z |
|---|---|---|
| 2.275 | 33.250 | −1.842 |
| 2.177 | 33.250 | −1.716 |
| 2.079 | 33.250 | −1.589 |
| 1.980 | 33.250 | −1.463 |
| 1.881 | 33.250 | −1.337 |
| 1.781 | 33.250 | −1.212 |
| 1.680 | 33.250 | −1.088 |
| 1.579 | 33.250 | −0.964 |
| 1.475 | 33.250 | −0.842 |
| 1.370 | 33.250 | −0.721 |
| 1.263 | 33.250 | −0.602 |
| 1.154 | 33.250 | −0.484 |
| 1.043 | 33.250 | −0.369 |
| 0.930 | 33.250 | −0.256 |
| 0.815 | 33.250 | −0.144 |
| 0.699 | 33.250 | −0.035 |
| 0.581 | 33.250 | 0.073 |
| 0.461 | 33.250 | 0.180 |
| 0.341 | 33.250 | 0.286 |
| 0.220 | 33.250 | 0.391 |
| 0.098 | 33.250 | 0.495 |
| −0.024 | 33.250 | 0.598 |
| −0.146 | 33.250 | 0.701 |
| −0.269 | 33.250 | 0.804 |
| −0.392 | 33.250 | 0.906 |
| −0.516 | 33.250 | 1.009 |
| −0.639 | 33.250 | 1.110 |
| −0.763 | 33.250 | 1.212 |
| −0.887 | 33.250 | 1.313 |
| −1.011 | 33.250 | 1.414 |
| −1.135 | 33.250 | 1.515 |
| −1.260 | 33.250 | 1.616 |
| −1.385 | 33.250 | 1.715 |
| −1.511 | 33.250 | 1.815 |
| −1.637 | 33.250 | 1.914 |
| −1.763 | 33.250 | 2.012 |
| −1.890 | 33.250 | 2.110 |
| −2.017 | 33.250 | 2.207 |
| −2.145 | 33.250 | 2.303 |
| −2.274 | 33.250 | 2.398 |
| −2.404 | 33.250 | 2.492 |
| −2.534 | 33.250 | 2.585 |
| −2.665 | 33.250 | 2.676 |
| −2.671 | 33.250 | 2.680 |
| −2.676 | 33.250 | 2.682 |
| −2.682 | 33.250 | 2.682 |
| −2.688 | 33.250 | 2.681 |
| −2.693 | 33.250 | 2.678 |
| −2.696 | 33.250 | 2.672 |
| −2.696 | 33.250 | 2.666 |
| −2.694 | 33.250 | 2.661 |
| −2.691 | 33.250 | 2.655 |
| −2.836 | 34.900 | 2.549 |
| −2.716 | 34.900 | 2.441 |
| −2.597 | 34.900 | 2.333 |
| −2.477 | 34.900 | 2.224 |
| −2.359 | 34.900 | 2.115 |
| −2.240 | 34.900 | 2.005 |
| −2.122 | 34.900 | 1.895 |
| −2.005 | 34.900 | 1.785 |
| −1.887 | 34.900 | 1.675 |
| −1.769 | 34.900 | 1.564 |
| −1.652 | 34.900 | 1.454 |
| −1.534 | 34.900 | 1.344 |
| −1.416 | 34.900 | 1.234 |
| −1.298 | 34.900 | 1.125 |
| −1.179 | 34.900 | 1.015 |
| −1.060 | 34.900 | 0.907 |
| −0.940 | 34.900 | 0.798 |
| −0.820 | 34.900 | 0.691 |
| −0.699 | 34.900 | 0.585 |
| −0.577 | 34.900 | 0.479 |
| −0.455 | 34.900 | 0.374 |
| −0.331 | 34.900 | 0.270 |
| −0.207 | 34.900 | 0.168 |
| −0.082 | 34.900 | 0.066 |
| 0.044 | 34.900 | −0.035 |
| 0.171 | 34.900 | −0.135 |

TABLE 1-continued

| X | Y | Z |
|---|---|---|
| 0.298 | 34.900 | −0.233 |
| 0.426 | 34.900 | −0.331 |
| 0.554 | 34.900 | −0.429 |
| 0.682 | 34.900 | −0.528 |
| 0.810 | 34.900 | −0.626 |
| 0.937 | 34.900 | −0.726 |
| 1.063 | 34.900 | −0.827 |
| 1.187 | 34.900 | −0.929 |
| 1.311 | 34.900 | −1.032 |
| 1.434 | 34.900 | −1.137 |
| 1.556 | 34.900 | −1.243 |
| 1.677 | 34.900 | −1.349 |
| 1.797 | 34.900 | −1.456 |
| 1.918 | 34.900 | −1.563 |
| 2.039 | 34.900 | −1.670 |
| 2.159 | 34.900 | −1.777 |
| 2.280 | 34.900 | −1.884 |
| 2.401 | 34.900 | −1.990 |
| 2.523 | 34.900 | −2.096 |
| 2.645 | 34.900 | −2.201 |
| 2.768 | 34.900 | −2.306 |
| 2.891 | 34.900 | −2.409 |
| 3.016 | 34.900 | −2.512 |
| 3.142 | 34.900 | −2.613 |
| 3.147 | 34.900 | −2.617 |
| 3.153 | 34.900 | −2.619 |
| 3.160 | 34.900 | −2.619 |
| 3.166 | 34.900 | −2.618 |
| 3.172 | 34.900 | −2.614 |
| 3.175 | 34.900 | −2.608 |
| 3.176 | 34.900 | −2.602 |
| 3.175 | 34.900 | −2.596 |
| 3.172 | 34.900 | −2.590 |
| 3.168 | 34.900 | −2.585 |
| 3.058 | 34.900 | −2.466 |
| 2.950 | 34.900 | −2.346 |
| 2.842 | 34.900 | −2.225 |
| 2.735 | 34.900 | −2.103 |
| 2.628 | 34.900 | −1.982 |
| 2.521 | 34.900 | −1.860 |
| 2.414 | 34.900 | −1.738 |
| 2.307 | 34.900 | −1.617 |
| 2.200 | 34.900 | −1.496 |
| 2.092 | 34.900 | −1.375 |
| 1.983 | 34.900 | −1.254 |
| 1.874 | 34.900 | −1.135 |
| 1.764 | 34.900 | −1.016 |
| 1.652 | 34.900 | −0.899 |
| 1.539 | 34.900 | −0.784 |
| 1.423 | 34.900 | −0.670 |
| 1.306 | 34.900 | −0.558 |
| 1.187 | 34.900 | −0.449 |
| 1.066 | 34.900 | −0.341 |
| 0.943 | 34.900 | −0.235 |
| 0.819 | 34.900 | −0.131 |
| 0.694 | 34.900 | −0.028 |
| 0.568 | 34.900 | 0.073 |
| 0.441 | 34.900 | 0.174 |
| 0.314 | 34.900 | 0.274 |
| 0.187 | 34.900 | 0.374 |
| 0.059 | 34.900 | 0.473 |
| −0.069 | 34.900 | 0.573 |
| −0.198 | 34.900 | 0.672 |
| −0.326 | 34.900 | 0.770 |
| −0.454 | 34.900 | 0.869 |
| −0.582 | 34.900 | 0.968 |
| −0.711 | 34.900 | 1.067 |
| −0.839 | 34.900 | 1.165 |
| −0.968 | 34.900 | 1.263 |
| −1.097 | 34.900 | 1.361 |
| −1.226 | 34.900 | 1.459 |
| −1.356 | 34.900 | 1.556 |
| −1.486 | 34.900 | 1.652 |
| −1.617 | 34.900 | 1.748 |
| −1.747 | 34.900 | 1.844 |
| −1.879 | 34.900 | 1.938 |
| −2.011 | 34.900 | 2.032 |
| −2.144 | 34.900 | 2.125 |

TABLE 1-continued

| X | Y | Z |
|---|---|---|
| −2.277 | 34.900 | 2.217 |
| −2.411 | 34.900 | 2.307 |
| −2.547 | 34.900 | 2.396 |
| −2.683 | 34.900 | 2.484 |
| −2.820 | 34.900 | 2.570 |
| −2.824 | 34.900 | 2.572 |
| −2.829 | 34.900 | 2.574 |
| −2.834 | 34.900 | 2.574 |
| −2.839 | 34.900 | 2.574 |
| −2.843 | 34.900 | 2.571 |
| −2.844 | 34.900 | 2.566 |
| −2.844 | 34.900 | 2.561 |
| −2.842 | 34.900 | 2.557 |
| −2.839 | 34.900 | 2.553 |
| −2.980 | 36.550 | 2.443 |
| −2.854 | 36.550 | 2.339 |
| −2.729 | 36.550 | 2.236 |
| −2.603 | 36.550 | 2.131 |
| −2.478 | 36.550 | 2.026 |
| −2.354 | 36.550 | 1.921 |
| −2.229 | 36.550 | 1.816 |
| −2.105 | 36.550 | 1.710 |
| −1.981 | 36.550 | 1.604 |
| −1.857 | 36.550 | 1.497 |
| −1.734 | 36.550 | 1.391 |
| −1.610 | 36.550 | 1.285 |
| −1.485 | 36.550 | 1.179 |
| −1.361 | 36.550 | 1.074 |
| −1.236 | 36.550 | 0.969 |
| −1.111 | 36.550 | 0.865 |
| −0.985 | 36.550 | 0.761 |
| −0.858 | 36.550 | 0.658 |
| −0.730 | 36.550 | 0.557 |
| −0.602 | 36.550 | 0.456 |
| −0.473 | 36.550 | 0.356 |
| −0.343 | 36.550 | 0.258 |
| −0.212 | 36.550 | 0.161 |
| −0.080 | 36.550 | 0.065 |
| 0.053 | 36.550 | −0.029 |
| 0.187 | 36.550 | −0.122 |
| 0.322 | 36.550 | −0.214 |
| 0.457 | 36.550 | −0.305 |
| 0.593 | 36.550 | −0.396 |
| 0.729 | 36.550 | −0.487 |
| 0.864 | 36.550 | −0.577 |
| 0.999 | 36.550 | −0.669 |
| 1.134 | 36.550 | −0.761 |
| 1.268 | 36.550 | −0.854 |
| 1.401 | 36.550 | −0.949 |
| 1.532 | 36.550 | −1.045 |
| 1.663 | 36.550 | −1.143 |
| 1.793 | 36.550 | −1.241 |
| 1.922 | 36.550 | −1.341 |
| 2.051 | 36.550 | −1.441 |
| 2.179 | 36.550 | −1.542 |
| 2.307 | 36.550 | −1.643 |
| 2.434 | 36.550 | −1.745 |
| 2.562 | 36.550 | −1.846 |
| 2.690 | 36.550 | −1.948 |
| 2.818 | 36.550 | −2.048 |
| 2.948 | 36.550 | −2.148 |
| 3.078 | 36.550 | −2.247 |
| 3.209 | 36.550 | −2.344 |
| 3.341 | 36.550 | −2.438 |
| 3.346 | 36.550 | −2.441 |
| 3.351 | 36.550 | −2.443 |
| 3.357 | 36.550 | −2.442 |
| 3.362 | 36.550 | −2.440 |
| 3.367 | 36.550 | −2.437 |
| 3.369 | 36.550 | −2.432 |
| 3.370 | 36.550 | −2.426 |
| 3.369 | 36.550 | −2.420 |
| 3.367 | 36.550 | −2.415 |
| 3.363 | 36.550 | −2.411 |
| 3.244 | 36.550 | −2.299 |
| 3.126 | 36.550 | −2.186 |
| 3.009 | 36.550 | −2.071 |
| 2.893 | 36.550 | −1.956 |

TABLE 1-continued

| X | Y | Z |
|---|---|---|
| 2.777 | 36.550 | −1.841 |
| 2.661 | 36.550 | −1.725 |
| 2.546 | 36.550 | −1.609 |
| 2.430 | 36.550 | −1.494 |
| 2.313 | 36.550 | −1.379 |
| 2.196 | 36.550 | −1.265 |
| 2.078 | 36.550 | −1.152 |
| 1.959 | 36.550 | −1.040 |
| 1.838 | 36.550 | −0.929 |
| 1.716 | 36.550 | −0.820 |
| 1.593 | 36.550 | −0.713 |
| 1.467 | 36.550 | −0.608 |
| 1.341 | 36.550 | −0.505 |
| 1.212 | 36.550 | −0.403 |
| 1.083 | 36.550 | −0.303 |
| 0.952 | 36.550 | −0.205 |
| 0.820 | 36.550 | −0.108 |
| 0.688 | 36.550 | −0.012 |
| 0.555 | 36.550 | 0.084 |
| 0.422 | 36.550 | 0.179 |
| 0.289 | 36.550 | 0.274 |
| 0.156 | 36.550 | 0.369 |
| 0.022 | 36.550 | 0.464 |
| −0.111 | 36.550 | 0.558 |
| −0.244 | 36.550 | 0.653 |
| −0.378 | 36.550 | 0.748 |
| −0.511 | 36.550 | 0.842 |
| −0.644 | 36.550 | 0.937 |
| −0.778 | 36.550 | 1.032 |
| −0.911 | 36.550 | 1.127 |
| −1.045 | 36.550 | 1.221 |
| −1.179 | 36.550 | 1.315 |
| −1.313 | 36.550 | 1.408 |
| −1.447 | 36.550 | 1.501 |
| −1.582 | 36.550 | 1.594 |
| −1.718 | 36.550 | 1.686 |
| −1.853 | 36.550 | 1.777 |
| −1.990 | 36.550 | 1.867 |
| −2.127 | 36.550 | 1.956 |
| −2.265 | 36.550 | 2.044 |
| −2.404 | 36.550 | 2.131 |
| −2.543 | 36.550 | 2.216 |
| −2.684 | 36.550 | 2.299 |
| −2.825 | 36.550 | 2.381 |
| −2.967 | 36.550 | 2.462 |
| −2.971 | 36.550 | 2.464 |
| −2.975 | 36.550 | 2.465 |
| −2.979 | 36.550 | 2.465 |
| −2.983 | 36.550 | 2.464 |
| −2.986 | 36.550 | 2.461 |
| −2.988 | 36.550 | 2.457 |
| −2.987 | 36.550 | 2.453 |
| −2.986 | 36.550 | 2.449 |
| −2.983 | 36.550 | 2.446 |
| −3.126 | 38.200 | 2.333 |
| −2.993 | 38.200 | 2.234 |
| −2.861 | 38.200 | 2.136 |
| −2.728 | 38.200 | 2.037 |
| −2.596 | 38.200 | 1.938 |
| −2.465 | 38.200 | 1.839 |
| −2.333 | 38.200 | 1.739 |
| −2.202 | 38.200 | 1.639 |
| −2.071 | 38.200 | 1.538 |
| −1.940 | 38.200 | 1.438 |
| −1.809 | 38.200 | 1.338 |
| −1.677 | 38.200 | 1.238 |
| −1.546 | 38.200 | 1.138 |
| −1.414 | 38.200 | 1.039 |
| −1.282 | 38.200 | 0.940 |
| −1.149 | 38.200 | 0.842 |
| −1.016 | 38.200 | 0.744 |
| −0.882 | 38.200 | 0.648 |
| −0.747 | 38.200 | 0.553 |
| −0.611 | 38.200 | 0.458 |
| −0.475 | 38.200 | 0.365 |
| −0.338 | 38.200 | 0.274 |
| −0.200 | 38.200 | 0.183 |
| −0.061 | 38.200 | 0.094 |

TABLE 1-continued

| X | Y | Z |
|---|---|---|
| 0.079 | 38.200 | 0.006 |
| 0.219 | 38.200 | −0.081 |
| 0.360 | 38.200 | −0.166 |
| 0.502 | 38.200 | −0.251 |
| 0.644 | 38.200 | −0.335 |
| 0.786 | 38.200 | −0.419 |
| 0.929 | 38.200 | −0.502 |
| 1.071 | 38.200 | −0.586 |
| 1.213 | 38.200 | −0.670 |
| 1.355 | 38.200 | −0.755 |
| 1.496 | 38.200 | −0.841 |
| 1.636 | 38.200 | −0.928 |
| 1.775 | 38.200 | −1.017 |
| 1.913 | 38.200 | −1.108 |
| 2.050 | 38.200 | −1.200 |
| 2.186 | 38.200 | −1.293 |
| 2.321 | 38.200 | −1.388 |
| 2.456 | 38.200 | −1.484 |
| 2.589 | 38.200 | −1.580 |
| 2.723 | 38.200 | −1.677 |
| 2.857 | 38.200 | −1.774 |
| 2.990 | 38.200 | −1.871 |
| 3.125 | 38.200 | −1.966 |
| 3.260 | 38.200 | −2.061 |
| 3.397 | 38.200 | −2.154 |
| 3.535 | 38.200 | −2.244 |
| 3.540 | 38.200 | −2.247 |
| 3.545 | 38.200 | −2.248 |
| 3.551 | 38.200 | −2.248 |
| 3.556 | 38.200 | −2.246 |
| 3.560 | 38.200 | −2.243 |
| 3.562 | 38.200 | −2.237 |
| 3.562 | 38.200 | −2.232 |
| 3.561 | 38.200 | −2.226 |
| 3.558 | 38.200 | −2.222 |
| 3.554 | 38.200 | −2.218 |
| 3.425 | 38.200 | −2.114 |
| 3.298 | 38.200 | −2.008 |
| 3.173 | 38.200 | −1.901 |
| 3.048 | 38.200 | −1.793 |
| 2.923 | 38.200 | −1.684 |
| 2.798 | 38.200 | −1.575 |
| 2.674 | 38.200 | −1.467 |
| 2.548 | 38.200 | −1.359 |
| 2.422 | 38.200 | −1.252 |
| 2.295 | 38.200 | −1.147 |
| 2.166 | 38.200 | −1.043 |
| 2.037 | 38.200 | −0.940 |
| 1.905 | 38.200 | −0.840 |
| 1.773 | 38.200 | −0.741 |
| 1.639 | 38.200 | −0.644 |
| 1.504 | 38.200 | −0.548 |
| 1.368 | 38.200 | −0.455 |
| 1.231 | 38.200 | −0.362 |
| 1.093 | 38.200 | −0.271 |
| 0.954 | 38.200 | −0.180 |
| 0.816 | 38.200 | −0.091 |
| 0.677 | 38.200 | −0.001 |
| 0.538 | 38.200 | 0.089 |
| 0.399 | 38.200 | 0.178 |
| 0.260 | 38.200 | 0.268 |
| 0.121 | 38.200 | 0.358 |
| −0.017 | 38.200 | 0.448 |
| −0.156 | 38.200 | 0.538 |
| −0.294 | 38.200 | 0.628 |
| −0.433 | 38.200 | 0.719 |
| −0.571 | 38.200 | 0.809 |
| −0.709 | 38.200 | 0.900 |
| −0.848 | 38.200 | 0.991 |
| −0.986 | 38.200 | 1.081 |
| −1.124 | 38.200 | 1.171 |
| −1.263 | 38.200 | 1.261 |
| −1.402 | 38.200 | 1.351 |
| −1.541 | 38.200 | 1.440 |
| −1.681 | 38.200 | 1.529 |
| −1.821 | 38.200 | 1.616 |
| −1.962 | 38.200 | 1.703 |
| −2.103 | 38.200 | 1.789 |

TABLE 1-continued

| X | Y | Z |
|---|---|---|
| −2.245 | 38.200 | 1.874 |
| −2.388 | 38.200 | 1.957 |
| −2.531 | 38.200 | 2.039 |
| −2.676 | 38.200 | 2.120 |
| −2.821 | 38.200 | 2.198 |
| −2.967 | 38.200 | 2.276 |
| −3.114 | 38.200 | 2.352 |
| −3.118 | 38.200 | 2.354 |
| −3.121 | 38.200 | 2.354 |
| −3.125 | 38.200 | 2.354 |
| −3.129 | 38.200 | 2.352 |
| −3.132 | 38.200 | 2.350 |
| −3.133 | 38.200 | 2.346 |
| −3.133 | 38.200 | 2.342 |
| −3.131 | 38.200 | 2.338 |
| −3.129 | 38.200 | 2.335 |
| −3.265 | 39.850 | 2.224 |
| −3.127 | 39.850 | 2.130 |
| −2.988 | 39.850 | 2.035 |
| −2.848 | 39.850 | 1.942 |
| −2.709 | 39.850 | 1.848 |
| −2.570 | 39.850 | 1.755 |
| −2.430 | 39.850 | 1.662 |
| −2.291 | 39.850 | 1.568 |
| −2.152 | 39.850 | 1.475 |
| −2.012 | 39.850 | 1.382 |
| −1.872 | 39.850 | 1.289 |
| −1.732 | 39.850 | 1.196 |
| −1.592 | 39.850 | 1.104 |
| −1.452 | 39.850 | 1.012 |
| −1.311 | 39.850 | 0.921 |
| −1.170 | 39.850 | 0.831 |
| −1.028 | 39.850 | 0.741 |
| −0.886 | 39.850 | 0.651 |
| −0.744 | 39.850 | 0.563 |
| −0.600 | 39.850 | 0.476 |
| −0.457 | 39.850 | 0.389 |
| −0.312 | 39.850 | 0.304 |
| −0.167 | 39.850 | 0.220 |
| −0.021 | 39.850 | 0.136 |
| 0.125 | 39.850 | 0.054 |
| 0.272 | 39.850 | −0.027 |
| 0.419 | 39.850 | −0.107 |
| 0.567 | 39.850 | −0.186 |
| 0.715 | 39.850 | −0.264 |
| 0.864 | 39.850 | −0.341 |
| 1.014 | 39.850 | −0.418 |
| 1.163 | 39.850 | −0.494 |
| 1.312 | 39.850 | −0.570 |
| 1.462 | 39.850 | −0.647 |
| 1.611 | 39.850 | −0.724 |
| 1.759 | 39.850 | −0.802 |
| 1.907 | 39.850 | −0.881 |
| 2.054 | 39.850 | −0.962 |
| 2.200 | 39.850 | −1.045 |
| 2.345 | 39.850 | −1.129 |
| 2.489 | 39.850 | −1.215 |
| 2.632 | 39.850 | −1.303 |
| 2.774 | 39.850 | −1.392 |
| 2.916 | 39.850 | −1.482 |
| 3.057 | 39.850 | −1.572 |
| 3.198 | 39.850 | −1.663 |
| 3.340 | 39.850 | −1.753 |
| 3.482 | 39.850 | −1.843 |
| 3.624 | 39.850 | −1.931 |
| 3.767 | 39.850 | −2.019 |
| 3.773 | 39.850 | −2.021 |
| 3.778 | 39.850 | −2.022 |
| 3.783 | 39.850 | −2.022 |
| 3.788 | 39.850 | −2.020 |
| 3.792 | 39.850 | −2.017 |
| 3.794 | 39.850 | −2.012 |
| 3.793 | 39.850 | −2.006 |
| 3.792 | 39.850 | −2.001 |
| 3.788 | 39.850 | −1.997 |
| 3.784 | 39.850 | −1.993 |
| 3.647 | 39.850 | −1.897 |
| 3.511 | 39.850 | −1.798 |

TABLE 1-continued

| X | Y | Z |
|---|---|---|
| 3.376 | 39.850 | −1.699 |
| 3.241 | 39.850 | −1.599 |
| 3.106 | 39.850 | −1.499 |
| 2.971 | 39.850 | −1.399 |
| 2.835 | 39.850 | −1.300 |
| 2.699 | 39.850 | −1.203 |
| 2.561 | 39.850 | −1.107 |
| 2.423 | 39.850 | −1.012 |
| 2.283 | 39.850 | −0.919 |
| 2.141 | 39.850 | −0.828 |
| 1.999 | 39.850 | −0.740 |
| 1.856 | 39.850 | −0.652 |
| 1.711 | 39.850 | −0.567 |
| 1.566 | 39.850 | −0.482 |
| 1.420 | 39.850 | −0.399 |
| 1.274 | 39.850 | −0.316 |
| 1.128 | 39.850 | −0.234 |
| 0.982 | 39.850 | −0.151 |
| 0.836 | 39.850 | −0.069 |
| 0.690 | 39.850 | 0.014 |
| 0.544 | 39.850 | 0.098 |
| 0.399 | 39.850 | 0.182 |
| 0.254 | 39.850 | 0.266 |
| 0.109 | 39.850 | 0.351 |
| −0.036 | 39.850 | 0.436 |
| −0.181 | 39.850 | 0.521 |
| −0.325 | 39.850 | 0.607 |
| −0.469 | 39.850 | 0.693 |
| −0.614 | 39.850 | 0.778 |
| −0.758 | 39.850 | 0.864 |
| −0.902 | 39.850 | 0.950 |
| −1.046 | 39.850 | 1.036 |
| −1.190 | 39.850 | 1.122 |
| −1.335 | 39.850 | 1.207 |
| −1.480 | 39.850 | 1.292 |
| −1.625 | 39.850 | 1.377 |
| −1.770 | 39.850 | 1.461 |
| −1.916 | 39.850 | 1.544 |
| −2.063 | 39.850 | 1.626 |
| −2.209 | 39.850 | 1.707 |
| −2.357 | 39.850 | 1.788 |
| −2.505 | 39.850 | 1.867 |
| −2.654 | 39.850 | 1.944 |
| −2.803 | 39.850 | 2.020 |
| −2.954 | 39.850 | 2.095 |
| −3.105 | 39.850 | 2.167 |
| −3.258 | 39.850 | 2.237 |
| −3.261 | 39.850 | 2.238 |
| −3.264 | 39.850 | 2.239 |
| −3.267 | 39.850 | 2.239 |
| −3.270 | 39.850 | 2.238 |
| −3.272 | 39.850 | 2.236 |
| −3.273 | 39.850 | 2.233 |
| −3.272 | 39.850 | 2.231 |
| −3.270 | 39.850 | 2.228 |
| −3.268 | 39.850 | 2.226 |

While the invention has been described in what is known as presently the preferred embodiment, it is to be understood that the invention is not to be limited to the disclosed embodiment but, on the contrary, is intended to cover various modifications and equivalent arrangements within the scope of the following claims. The present invention has been described in relation to particular embodiments, which are intended in all respects to be illustrative rather than restrictive.

From the foregoing, it will be seen that this invention is well adapted to attain all the ends and objects set forth above, together with other advantages which are obvious and inherent to the system and method. It will be understood that certain features and sub-combinations are of utility and may be employed without reference to other features and sub-combinations. This is contemplated by and within the scope of the claims.

What is claimed is:

1. A compressor with an engine centerline and a component having an attachment comprising: a platform extending radially outward from the attachment and an airfoil extending radially outward from the platform, the airfoil having an uncoated profile substantially in accordance with Cartesian coordinate values of $X_1$ and $Z_1$, for each distance $Y_1$ in inches as set forth in Table 1, carried to three decimal places, wherein $Y_1$ is a distance measured radially outward from the engine centerline, the $X_1$ and $Z_1$ coordinate values being joined in smooth continuing splines to form airfoil sections and the airfoil sections joined smoothly to form the profile.

2. The compressor component of claim 1, wherein the airfoil has manufacturing tolerances of approximately +/−0.012 inches.

3. The compressor component of claim 1, wherein the airfoil has a root end proximate the attachment and a tip end spaced at opposite the root end.

4. The compressor component of claim 1 further comprising a squealer tip at the tip end.

5. The compressor component of claim 1, wherein the compressor component is a rotating blade.

6. The compressor component of claim 5, wherein the compressor component is located adjacent to inlet guide vanes of a compressor.

7. The compressor component of claim 1, wherein the airfoil sections can be scaled uniformly in X, Y and Z directions.

8. An airfoil for a compressor blade with an engine centerline, the airfoil having an uncoated profile substantially in accordance with Cartesian coordinate values of $X_1$, $Y_1$, and $Z_1$ as set forth in Table 1, carried to three decimal places, wherein $Y_1$ is a distance measured in inches radially outward from the engine centerline, the $X_1$ and $Z_1$ coordinate values being joined in smooth continuing splines to form airfoil sections and the airfoil sections joined smoothly to form the profile.

9. The airfoil of claim 8, wherein the airfoil has manufacturing tolerances of approximately +/−0.012 inches.

10. The airfoil of claim 8, wherein the airfoil has a first end and an opposing second end.

11. The airfoil of claim 10, wherein the first end is attached to a platform of the compressor blade.

12. The airfoil of claim 8 further comprising a squealer tip positioned at a second end of the airfoil opposite of a first end.

13. The airfoil of claim 8, wherein the airfoil sections can be scaled uniformly.

14. A compressor portion comprising a disk having a plurality of compressor blades extending radially outward from the disk, each of the plurality of compressor blades having an airfoil with an uncoated nominal profile substantially in accordance with Cartesian coordinate values of X, Y and Z, set forth in inches in Table 1, with the Y coordinate values at perpendicular distances from planes normal to a radius from an engine centerline, wherein airfoil sections are defined at each distance Y by connecting the X and Z coordinate values with smooth continuing splines, and the airfoil sections are joined smoothly to form the airfoil profile, wherein the compressor blades are located adjacent to inlet guide vanes of the compressor, and the compressor blades have an axial length such that a stage of compressor vanes spaced directly downstream of the compressor blades have an axial length sized to compliment the profile of the compressor blades.

15. The compressor of claim 14, wherein the airfoil has a root end proximate the attachment and a tip end spaced at opposite the root end.

16. The compressor of claim 15, wherein the plurality of compressor blades rotate about an axis of a gas turbine engine.

17. The compressor of claim 16, wherein the plurality of compressor blades each have a squealer tip positioned at a tip end of the airfoil.

18. The compressor of claim 16, wherein the airfoil profile is within +/−0.090 inches in a direction normal to the airfoil.

19. The compressor component of claim 14, wherein the airfoil has manufacturing tolerances of approximately +/−0.012 inches.

20. The compressor component of claim 14, wherein each of the plurality of compressor blades is a rotating blade.

* * * * *